United States Patent [19]

Gustafsson

[11] 3,949,728

[45] Apr. 13, 1976

[54] CLAY PIGEON THROWING DEVICE

[75] Inventor: Arne Gustafsson, Vikingstad, Sweden

[73] Assignee: Stiga AB, Sweden

[22] Filed: Sept. 11, 1974

[21] Appl. No.: 504,929

[52] U.S. Cl. ..... 124/8; 124/36; 124/30 R

[51] Int. Cl.[2] ..... F41B 3/04

[58] Field of Search ..... 124/8, 7, 6, 36, 43, 42, 124/30 R; 248/257, 258, 289, 247, 254, 70, 157, 54

[56] References Cited

UNITED STATES PATENTS

| | | | |
|---|---|---|---|
| 281,356 | 7/1883 | Fischer | 124/8 |
| 1,867,578 | 7/1932 | Lorimer | 124/8 |
| 2,925,077 | 2/1960 | Luebkeman | 124/43 X |

*Primary Examiner*—Richard C. Pinkham
*Assistant Examiner*—William R. Browne
*Attorney, Agent, or Firm*—John C. Smith, Jr.

[57] ABSTRACT

A clay pigeon trap comprises a shaft member, provided with an adjustable support mounting, which carries at one end a casing containing a bearing providing a pivot mounting for an angularly movable throwing arm and tensioning apparatus for spring loading the throwing arm prior to a throwing stroke. The throwing arm has a pivot shaft projecting perpendicularly from its underside to engage in said bearing and the tensioning apparatus includes a freely rotatable tensioning bush within the casing, a helical coil torsion spring coupling the tensioning bush to the pivot shaft within the casing, and a tensioning arm which is detachably secured to the tensioning bush and which projects outside the casing to enable the bush to be turned so as to tension the spring by manipulating the tensioning arm whilst the throwing arm is held alongside the shaft member in its rearwardly directed position.

8 Claims, 2 Drawing Figures

CLAY PIGEON THROWING DEVICE

BACKGROUND OF THE INVENTION

It is known for a clay pigeon trap to comprise a tubular shaft provided at one end with a casing and having pivot means to provide an adjustable swivel mounting to enable setting in a desired orientation, the pivot means including a pivot pin adapted to be rotatably fitted in a bearing housing of a mounting member which can be fixed to a suitable external support such as, for example, a tree stump or outcrop, means being provided to lock the mounting after the tubular shaft has been set in its required position. The casing contains a bearing which rotatably supports the pivot shaft of a throwing arm which is angularly movable between a rearwardly-directed position lying substantially alongside the tubular shaft and an opposite forwardly-directed position and which is provided with a longitudinal strip or rail along its upper side to support a clay pigeon which rolls along the length of the arm during projection in a throwing stroke. The pivot shaft projects perpendicularly from the underside of the throwing arm, and a short extension provides a mounting for one end of a strong coil spring. The other end of the coil spring is fixed to the upper side of the tubular shaft, and the arrangement is such that the coil spring applies a spring loading to the throwing arm and biases said arm to its forwardly-directed position extending away from, but in line with, the tubular shaft. Catch means with a releasable trigger are provided to maintain the throwing arm, against the spring loading, in its rearwardly-directed position alongside the tubular shaft prior to firing.

Known traps of the above kind generally function satisfactorily, but the operation thereof is subject to certain drawbacks. In particular, a substantial effort is usually necessary for initially spring loading the throwing arm and as the coil spring is heavily tensioned the trap is difficult to set and handle. Also, a substantial effort is usually necessary for releasing the catch and it is not generally practicable to utilise an automatic time release device for this purpose.

OBJECT AND SUMMARY OF THE INVENTION

An object of the present invention is to provide an improved construction of clay pigeon trap in which the abovementioned difficulties may be reduced or avoided and which can also provide a high degree of versatility and enable comparatively easy and cheap manufacture.

Broadly, the present invention provides a clay pigeon trap comprising a shaft member, a casing from which the shaft member at one end projects laterally, means for adjustably mounting said shaft member and casing upon a rigid support to provide a desired horizontal and vertical angular setting of the shaft member, a pivotally-mounted throwing arm angularly movable between a rearwardly-directed position lying substantially alongside the shaft member and an opposite forwardly-directed position, said throwing arm having a pivot shaft projecting perpendicularly from the underside of said arm, a bearing which rotatably supports said pivot shaft within said casing, releasable catch means for holding the throwing arm in said rearwardly-directed position alongside the shaft member, and tensioning means for spring loading the throwing arm in said rearwardly-directed position so that on release of the catch means the throwing arm executes a throwing stroke and swivels forwards to said forwardly-directed position under the influence of the spring loading, wherein the tensioning means comprises:

a. a tensioning bush fitted within said casing for free rotation therein coaxially with the pivot shaft of the throwing arm;

b. a helical coil torsion spring also fitted within said casing for free rotation therein coaxially with the tensioning bush and pivot shaft;

c. said torsion spring having, at its lower end, a first terminal portion which operatively connects the spring to the pivot shaft by engagement within slot means in said pivot shaft, and said torsion spring having, at its upper end, a second terminal portion which engages with and operatively connects the spring to said tensioning bush, whereby the pivot shaft and tensioning bush are coupled together, for rotation, through said torsion spring;

d. a tensioning arm which connects to the tensioning bush so as to enable said bush to be turned, whilst the throwing arm is held in said rearwardly-directed position by said catch means, by moving the tensioning arm angularly from an inoperative position to an operative tensioning position; and e. means for locking the tensioning arm in said operative tensioning position.

Other features will become apparent from the following description, given by way of example, of a specific preferred embodiment illustrated in the accompanying diagrammatic drawings.

DESCRIPTION OF DRAWINGS

In said drawings.

DESCRIPTION OF THE SPECIFIC EMBODIMENT

Figure 1:
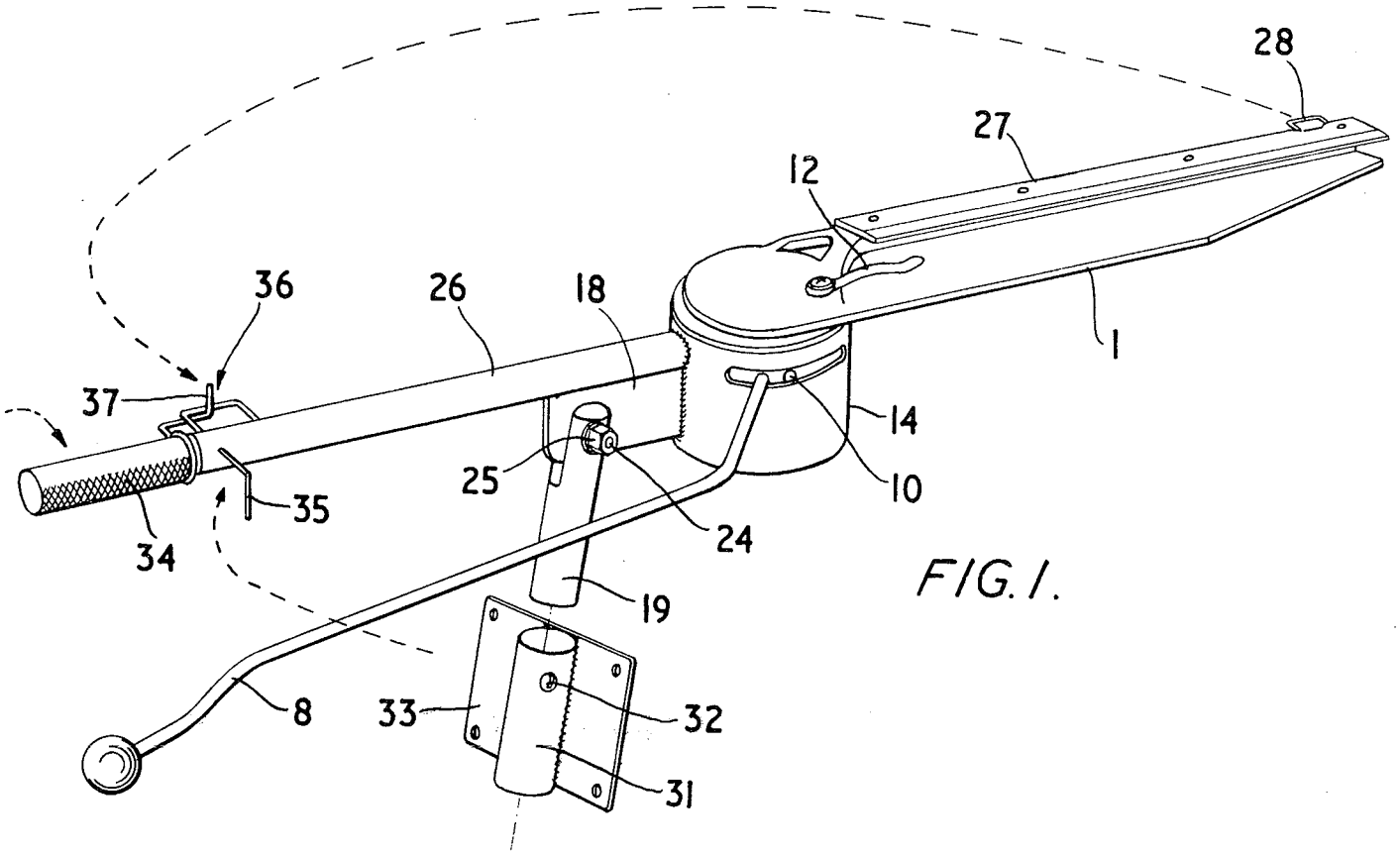
FIG. 1 is a perspective view of one constructional form of clay pigeon trap in accordance with the invention.
Figure 2:
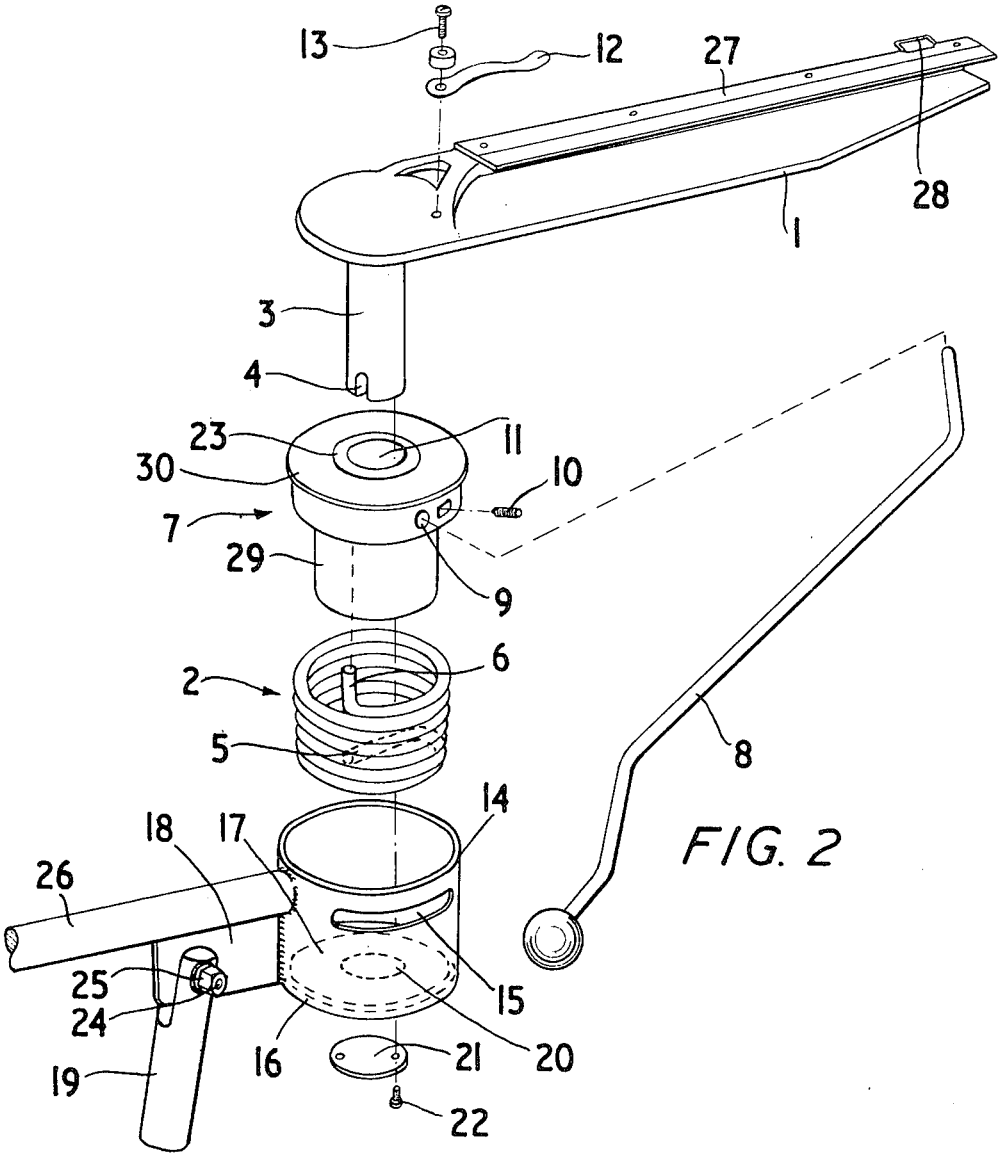
FIG. 2 is an exploded view showing, in perspective, components of the throwing mechanism of the trap of FIG. 1.

The clay pigeon trap illustrated in the drawings comprises a casing 14 of hollow cylindrical form having an open upper end and a flat apertured bottom or base 16 at the lower end. Rigidly connected to the casing 14, adjacent the open upper end is a radially projecting shaft member 26 which is conveniently of tubular form, and mounted on the base 16 within the casing is a flat disc 17 composed of low friction material, such as nylon for example.

Also housed within the casing 14 is a spring 2, in the form of a helical coil torsion spring, which is freely movable therein, and a tensioning member in the form of a rotatable tensioning bush 7 having a reduced diameter lower part 29 projecting into the coil of the spring 2. The upper part 30 of the bush 7 has a larger diameter and extends laterally beyond the circumference of the coil of the spring 2 which rests underneath on the disc 17.

The trap also includes a throwing arm 1, made preferably of a lightweight material such as, for example, a hard plastics material, which is provided along its top edge with a strip 27 against which a clay pigeon can roll in travelling along the arm during projection, thereby to assist in stabilising rolling movement of the clay pigeon. Adjacent the inner end of the strip 27, the throwing arm 1 is provided with a blade spring 12, fixed by means of a screw 13, which serves to hold the clay pigeon in a predetermined position at the commencement of a throwing stroke and until, during the throwing stroke, centrifugal force becomes strong enough to detach the clay pigeon and project it along the arm at maximum exit speed.

The throwing arm is also provided at its inner end with a pivot shaft 3 which projects perpendicularly downwards from the underside and engages in the central bore 11 of a bearing 23 fitted axially in the body of the tensioning bush 7.

The pivot shaft 3 is formed at its lower end with a diametrically extending slot 4 adapted to receive and grip a diametrically extending terminal portion of the lower end of the spring 2. At its upper end, the spring 2 has an upwardly projecting terminal portion 6 which engages and fits within a non-central hole (not shown) drilled upwardly in the flange formed by the upper part 30 of the bush 7.

Detachably secured to the tensioning bush 7 is a laterally projecting tensioning arm 8 which passes through a circumferentially extending parallel-sided slot 15 in the side wall of the casing 14. The inner end of the tensioning arm 8 fits into a hole 9 in the upper part 30 of the bush 7 and is held therein by a locking screw 10. The slot 15 limits the range of angular movement of the arm 8.

The disc 17 and the underlying base 16 are formed with a central hole 20 through which the lower end of the pivot shaft 3 passes with clearance, and underneath the base 16 a retaining plate 21 of larger diameter than said hole 20 is fixed, by means of screws 22, to said lower end of the pivot shaft.

Adjacent its free outer end, the throwing arm 1 is provided with a laterally projecting loop 28 for engaging with a releasable catch device 36 on the tubular shaft 26 when the throwing arm is moved into a rearwardly-directed position alongside said shaft prior to a throwing stroke.

The tubular shaft 26 is also provided, towards its free rear end and adjacent the catch device 36, with a downwardly projecting hook or retaining arm 35 (see FIG. 1) adapted to engage and hold the tensioning arm 8 in an operative tensioning position alongside the shaft 26.

The form of releasable catch device 36 which is illustrated is only an example as its detailed construction does not form part of the present invention, but it includes a catch hook 37 which is adapted to engage the loop 28 when in a normal raised position. The catch hook 37 can be lowered, by manipulating a rotatable hand grip 34 for example, to disengage and release the loop 28 so as to permit the throwing arm 1, after having been spring-loaded in its rearwardly-directed position by tensioning the torsion spring 2, to execute a throwing stroke and swivel forwards through approximately 180° to its opposite forwardly-directed position (shown in FIG. 1).

On its underside, adjacent the casing 14, the tubular shaft 26 is provided with a depending web plate member 18 to which is connected to pivot pin or spigot 19 by means of a transverse bolt 24 fitted with a clamping nut 25. The pivot pin or spigot 19 is adapted to be fitted in the sleeve 31 of a mounting bracket having a flat plate portion 33, and it can turn, before being locked in position by the clamping nut 25, about the bolt 24 so as to enable the shaft 26 and casing 14 to be set at a desired angle of elevation.

For storage and transport, the tensioning arm 8 may be removed and placed so as to lie loose beside the tubular shaft 26, and the pivot pin or spigot 19 may also be turned to lie alongside the shaft 26.

To set up the trap for use, the tensioning arm 8 is secured in the hole 9 of the tensioning bush 7 by means of the locking screw 10. The mounting bracket is fixed by means of its flat plate portion 33 to a suitable support, such as a tree stump for example, so that the sleeve 31 is orientated vertically. Then the pivot pin or spigot 19, turned to extend downwards from the shaft 26, is slid into the sleeve 31 and is rotated therein to set the shaft 26 pointing in the required horizontal direction. The pin or spigot 19 is then locked in the sleeve, by means of a locking screw 32, and the clamping nut 25 is tightened after setting the required angle of elevation.

Subsequently, the throwing arm 1 is swung anti-clockwise through approximately 180° into its rearwardly-directed position alongside the shaft 26 and the loop 28 is latched on to the catch hook 37 of the releasable catch device 36. A clay pigeon is then inserted under the blade spring 12 and the throwing arm can be spring loaded by moving the tensioning arm 8 angularly, in an anti-clockwise direction, from a forward inoperative position to a rear operative tensioning position alongside the shaft 26 where it is retained by engagement with the hook or retaining arm 35.

The trap is then ready for firing and projection of the clay pigeon which takes place upon release of the catch device 36 to disengage the trigger catch hook 37 from the loop 28. The throwing arm then executes a throwing stroke, swinging or swivelling quickly through somewhat more than 180° and projects the clay pigeon.

Although only one specific embodiment has been described by way of example, it will be understood that other constructions can be devised within the scope of this invention as defined in the appended claims.

I claim:

1. A clay pigeon trap comprising a. a housing defining a chamber;

b. a tensioning bush rotatably mounted about its axis in said chamber and including a bore therein;

c. a throwing arm for releasably supporting a clay pigeon and including a pivot shaft positioned for rotation in said bore, said pivot shaft including a spring detachable securing means;

d. a helically coiled spring having two terminal ends and positioned in said chamber, one end of said spring being detachably secured to said securing means so as to releasably connect the spring and the throwing arm and the opposite end thereof being secured to said tensioning bush for biasing the pivotal movement of said throwing arm in one direction;

e. stationary means mounted on said housing and extending in a direction transverse to said axis;

f. first means mounted on said stationary means for releasably securing said throwing arm adjacent said stationary means against said biased pivotal movement when said coiled spring under tension;

g. a tensioning arm connected to said bush and projecting transversely of said axis;

h. second means mounted on said stationary means for securing said tensioning arm adjacent said stationary means against biased pivotal movement in the direction opposite said one direction;

i. whereby said throwing arm may be pivoted in said opposite direction to tension said coiled spring and be secured in position by said first releasable securing means, said coiled spring may be further tensioned by pivoting said tensioning arm and consequently rotating said bush in said one direction and securing said tensioning arm by said second securing means, and said throwing arm may be released by said first releasable securing means to permit said throwing arm to pivot in said one direction under the influence of said tensioned coiled spring and project a clay pigeon supported thereon.

2. A clay pigeon trap according to claim 1 wherein said one end of said coiled spring is secured to said pivot shaft.

3. A clay pigeon trap according to claim 2 wherein said chamber is cylindrical.

4. A clay pigeon trap according to claim 3 wherein said bore in said tensioning bush extends along said axis whereby both said bush and said throwing arm rotate about said axis.

5. A clay pigeon trap according to claim 4 wherein said tensioning bush is cylindrical, one portion thereof having a smaller diameter than another portion, and said coiled spring being arranged about said smaller diameter portion.

6. A clay pigeon trap according to claim 5 wherein said housing includes an elongated slot extending in a direction transverse to said axis, said tensioning arm projecting from said bush through said slot, the opposite ends of said slot being adapted to limit the pivotable movement of said tensioning arm.

7. A clay pigeon trap according to claim 6 wherein said first means on said stationary means is rotatable on said stationary means about a further axis transverse to said axis of said tensioning bush.

8. A clay pigeon trap according to claim 6 wherein said housing includes a base on the side opposite said throwing arm, said base having a hole at the point of intersection of the plane of said base and at said axis, a disc of low friction material disposed in said chamber between said base and said bush, said disc having a hole at the point of intersection of the axis and the plane of the disc, said pivot shaft extending through said holes in said disc and base, and a retaining member secured to said pivot shaft adjacent the side of said base opposite said disc to retain said pivot shaft.

* * * * *